US011021901B2

(12) United States Patent
Thielmann et al.

(10) Patent No.: US 11,021,901 B2
(45) Date of Patent: Jun. 1, 2021

(54) MULTI-JOINT HINGE

(71) Applicant: HETTICH-ONI GMBH & CO. KG, Vlotho (DE)

(72) Inventors: Eduard Thielmann, Lage (DE); Martin Nordieker, Hüllhorst (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 0 days.

(21) Appl. No.: 16/466,331

(22) PCT Filed: Dec. 4, 2017

(86) PCT No.: PCT/EP2017/081296
§ 371 (c)(1),
(2) Date: Jun. 4, 2019

(87) PCT Pub. No.: WO2018/104199
PCT Pub. Date: Jun. 14, 2018

(65) Prior Publication Data

US 2019/0383081 A1 Dec. 19, 2019

(30) Foreign Application Priority Data

Dec. 5, 2016 (DE) ..... 10 2016 123 498.2

(51) Int. Cl.
*E05F 3/20* (2006.01)
*E05D 3/16* (2006.01)
(Continued)

(52) U.S. Cl.
CPC ..... *E05F 3/20* (2013.01); *E05D 3/16* (2013.01); *E05D 11/0054* (2013.01); *E05F 3/10* (2013.01);
(Continued)

(58) Field of Classification Search
CPC ..... E05D 3/16; E05D 2003/166; E05F 3/10; E05F 3/20
See application file for complete search history.

(56) References Cited

U.S. PATENT DOCUMENTS 5,035,026 A * 7/1991 Carlo ..... E05D 3/16 16/288
6,374,459 B1 * 4/2002 Zetti ..... E05D 3/16 16/286
(Continued)

FOREIGN PATENT DOCUMENTS

DE 20200762 U1 4/2002
DE 202005016375 U1 12/2005
(Continued)

OTHER PUBLICATIONS

International Search Report dated Feb. 27, 2018 in related/corresponding International Application No. PCT/EP2017/081296.
(Continued)

*Primary Examiner* — Emily M Morgan
(74) *Attorney, Agent, or Firm* — Patent Portfolio Builders PLLC

(57) ABSTRACT

A multi-joint hinge includes a base part, on which a door bearing is held pivotably via a lever mechanism with a plurality of levers which are mounted in the manner of a parallelogram. A damping element for braking a closing movement and a spring element for tightening the door bearing in a closing area in the closing direction are arranged within the multi-joint hinge. The damping element and the spring element are connected in parallel.

7 Claims, 9 Drawing Sheets

(51) Int. Cl.
*E05D 11/00* (2006.01)
*E05F 3/10* (2006.01)

(52) U.S. Cl.
CPC ... *E05D 2011/0072* (2013.01); *E05Y 2201/11* (2013.01); *E05Y 2201/21* (2013.01); *E05Y 2201/264* (2013.01); *E05Y 2201/412* (2013.01); *E05Y 2800/176* (2013.01); *E05Y 2900/20* (2013.01); *E05Y 2900/30* (2013.01)

(56) References Cited

U.S. PATENT DOCUMENTS

| | | | | |
|---|---|---|---|---|
| 6,789,293 | B2 * | 9/2004 | Habegger | E05F 1/1276 16/289 |
| 7,591,046 | B2 * | 9/2009 | Zetti | E05D 3/16 16/286 |
| 7,987,558 | B2 | 8/2011 | Beckmann et al. | |
| 8,225,459 | B2 | 7/2012 | Waltemate et al. | |
| 8,321,996 | B2 * | 12/2012 | Hirtsiefer | E05D 15/46 16/286 |
| 10,221,597 | B2 | 3/2019 | Hammerer | |
| 10,662,690 | B2 * | 5/2020 | Schluge | E05D 15/401 |
| 2008/0276422 | A1 * | 11/2008 | Beckmann | E05D 11/0054 16/258 |
| 2011/0017191 | A1 * | 1/2011 | White | E05F 5/00 126/198 |
| 2013/0152339 | A1 * | 6/2013 | Hung | E05F 3/20 16/50 |
| 2015/0267452 | A1 * | 9/2015 | Zetti | E05D 3/06 16/65 |
| 2015/0337584 | A1 * | 11/2015 | Zetti | E05D 3/16 16/65 |
| 2017/0218671 | A1 * | 8/2017 | Frank | E05D 7/06 |
| 2017/0241175 | A1 * | 8/2017 | Hammerer | E05F 1/1253 |
| 2017/0306680 | A1 * | 10/2017 | Zetti | E05F 5/10 |
| 2018/0049336 | A1 * | 2/2018 | Manuel | E05F 3/20 |
| 2018/0087307 | A1 * | 3/2018 | Hammerer | E05F 3/20 |
| 2018/0106088 | A1 * | 4/2018 | Zetti | E05F 5/10 |
| 2020/0131830 | A1 * | 4/2020 | Byun | E05D 11/0054 |

FOREIGN PATENT DOCUMENTS

| | | | | |
|---|---|---|---|---|
| DE | 102005004957 | A1 | 8/2006 | |
| DE | 202007004621 | U1 | 8/2008 | |
| DE | 102005063588 | B3 * | 7/2013 | E05D 11/1064 |
| EP | 3040661 | A1 | 7/2016 | |
| WO | WO-2006082175 | A2 * | 8/2006 | E05D 11/0054 |
| WO | 2016090391 | A1 | 6/2016 | |

OTHER PUBLICATIONS

Search Report created on Oct. 27, 2017 in related/corresponding DE Application No. 10 2016 123 498.2.

Written Opinion dated Feb. 27, 2018 in related/corresponding International Application No. PCT/EP2017/081296.

* cited by examiner

MULTI-JOINT HINGE

BACKGROUND AND SUMMARY OF THE INVENTION

Exemplary embodiments of the present invention relate to a multi-joint hinge comprising a base part, on which a door bearing is held pivotably via a lever mechanism with a plurality of levers mounted in the manner of a parallelogram, and comprising within the multi-joint hinge a damping element for braking a closing movement and a spring element for pulling the door bearing in a closing area in the closing direction.

DE 20 2007 004 621 U1 discloses a multi-joint hinge comprising a stationary fastening element and a pivotable door bearing, which are connected to one another via a lever mechanism. To brake a closing movement shortly before the closed position, a damping element having a linear damper is provided. Furthermore, a spring element is arranged inside the lever mechanism, which ensures a retraction movement in a closing area. Such a multi-joint hinge has proven itself in practice, however, the installation space for the function of the damping and the pre-tensioning by the spring element is not optimally utilized.

Accordingly, exemplary embodiments of the present invention are directed to a multi-joint hinge having a compact structure and an improved damping and closing function.

According to an aspect of the invention, in the multi-joint hinge, a damping element for braking a closing movement and a spring element for pulling the door bearing are connected in parallel. The damping element and the spring element can thus be connected between the same levers of a lever mechanism or in parallel between the base part and a lever or the door bearing and a lever, so that the damping and pre-tensioning function can be constructed compactly. Due to the parallel connection of damping element and spring element, the relative movement between the damping element and the spring element is reduced, so that the required installation space is decreased.

The damping element and the spring element are preferably connected in parallel between the door bearing and a deflection lever of the lever mechanism. The damping element and the spring element are then moved together with the door bearing and the deflection lever, so that an installation space adjacent to a pivot axis on the base part is used for the lever mechanism, which enables improved force dissipation and good lever ratios.

The damping element can comprise at least one linear damper, preferably two linear dampers, having a damping axis, and the spring element can have at least one linearly acting spring with a spring axis, wherein the damping axis and the spring axis are aligned essentially parallel to one another over the entire pivot area of the door bearing. The damping axis and the spring axis do not have to be aligned exactly in parallel in this case, but rather at an angle range of less than 20°, in particular less than 10°, for example, so that the damping element and the spring element can be arranged closely adjacent to one another.

The multi-joint hinge is preferably designed as a seven-joint hinge, wherein the lever mechanism comprises four levers between the door bearing and the base part. In a closed position, the multi-joint hinge can be essentially box-shaped. The lever mechanism can be arranged located concealed by two essentially plate-shaped covers in this case, wherein the covers are arranged on opposing sides of the multi-joint hinge, and preferably have a curve guide, to be able to conceal the lever mechanism even in various open positions.

In one design, the lever mechanism has a deflection lever comprising a receptacle, formed in particular by at least one axis, between two plates, wherein the plates are connected to one another via at least one connecting web. In this case, the damping element and the spring element can be inserted on the receptacle of the deflection lever, so that they are arranged protected, preferably by the interior formed between the at least two plates and the connecting web. In the closed position, the damping element is located with its damping axes nearly completely inside the interior formed of the deflection lever, wherein it is located with at least one damping axis outside the interior formed of the deflection lever in the open position. A cap can be provided on the door bearing or the deflection lever in this case, to cover the interior toward the multi-joint hinge or the deflection lever, wherein the cap is displaceably mounted in relation to the door bearing or the deflection lever. The cap can be displaceably mounted via catch elements on at least one linear damper in the direction of the damping axis in this case and/or can be rotatably mounted on an axis of the deflection lever.

BRIEF DESCRIPTION OF THE DRAWING FIGURES

The invention will be explained in greater detail hereafter on the basis of an exemplary embodiment with reference to the appended drawings. In the figures.

DETAILED DESCRIPTION

Figure 1:
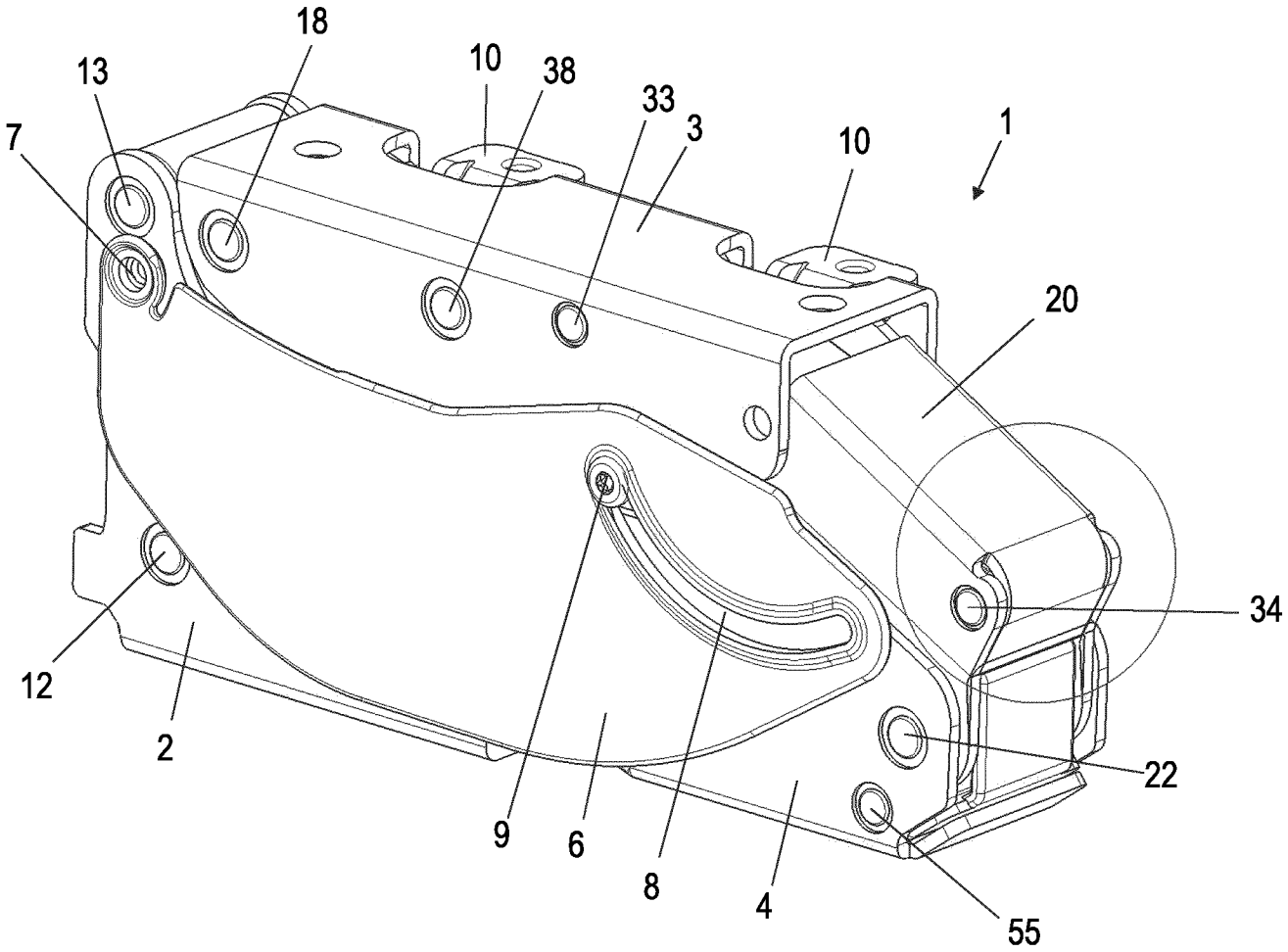
FIG. 1 shows a perspective view of a multi-joint hinge in a closed position.

A multi-joint hinge 1 comprises a base part 2, which is securable on a body of a piece of furniture or household appliance, and a door bearing 3, on which a door is fixable. Two protruding tabs 10 are provided on the door bearing 3, on which a door is fixable via screw connections or other fastening means. The door bearing 3 is pivotably mounted via a lever mechanism on the base part 2. In the closed position shown in FIG. 1, the multi-joint hinge is formed essentially box-shaped and comprises an interior located concealed, wherein a plate-shaped cover 6, which is rotatably mounted about an axis 7 on the base part 2, is provided on opposing sides.

Figure 2:
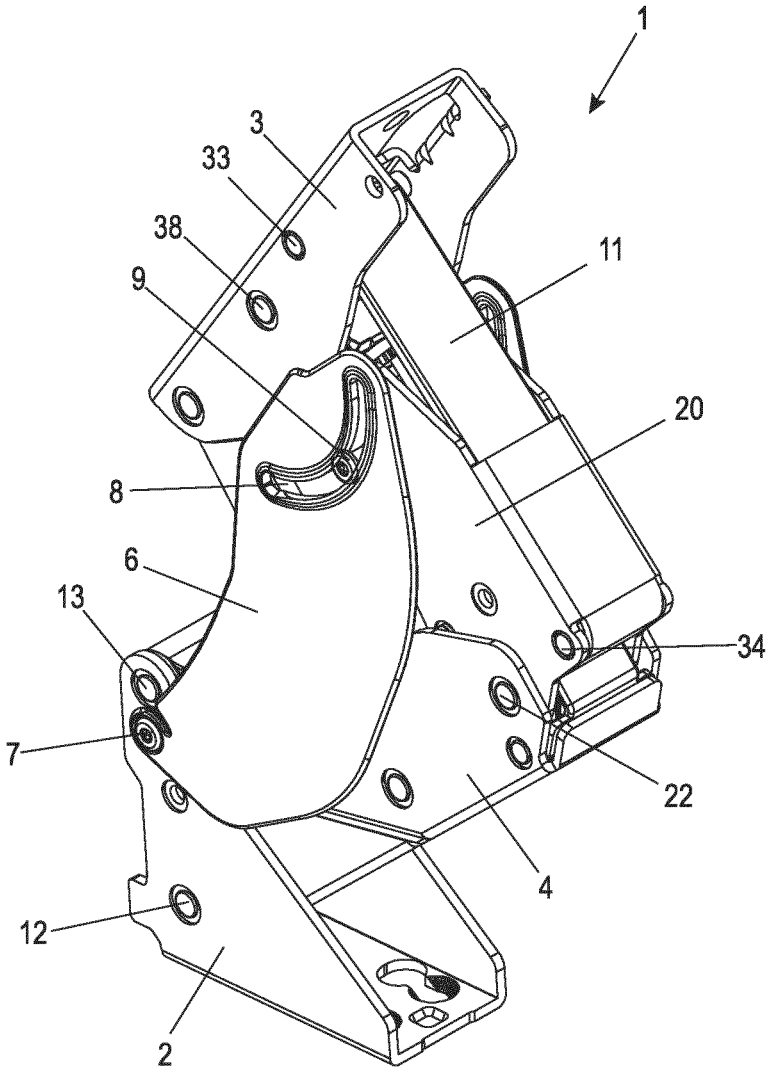
FIG. 2 shows a perspective view of the multi-joint hinge of FIG. 1 in a first open position.

In FIG. 2, the door bearing 3 has been pivoted in the opening direction, and it can be seen that the cover 6 was rotated about the axis 7 and therefore also covers a lever mechanism of the multi-joint hinge 1 in an open position. Each cover 6 comprises a curve guide 8, which is arc-shaped and in which a guide pin 9 engages, which is fixed on a deflection lever 20 of the lever mechanism. The two covers 6 are thus positively guided via the deflection lever 20.

An axis 12, on which a second lever 4 is rotatably mounted, is formed on the base part 2. The deflection lever 20, which is articulated with the door bearing 3 via an axis 38, is rotatably mounted via an axis 22 on the second lever 4. A cap 11, which covers an opening on the deflection lever 20, is provided between the deflection lever 20 and the door bearing 3.

Figure 3:
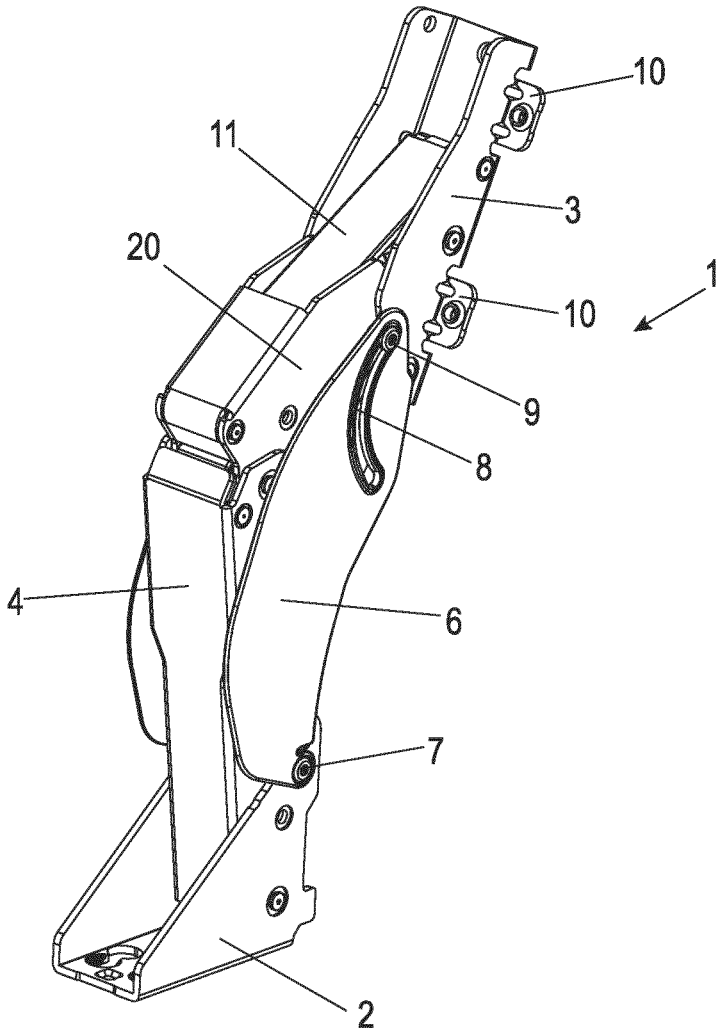
FIG. 3 shows a perspective view of the multi-joint hinge of FIG. 1 in a maximally open position.

A maximally open position of the multi-joint hinge 1 is shown in FIG. 3, and it is recognizable that the door bearing 3 was pivoted over more than 90°, in particular between 100° and 140°. An interior of the multi-joint hinge 1 is also protected via the second lever 4, the deflection lever 20, the cap 11, and the covers 6 in the open positions of FIGS. 2 and 3.

Figure 4:
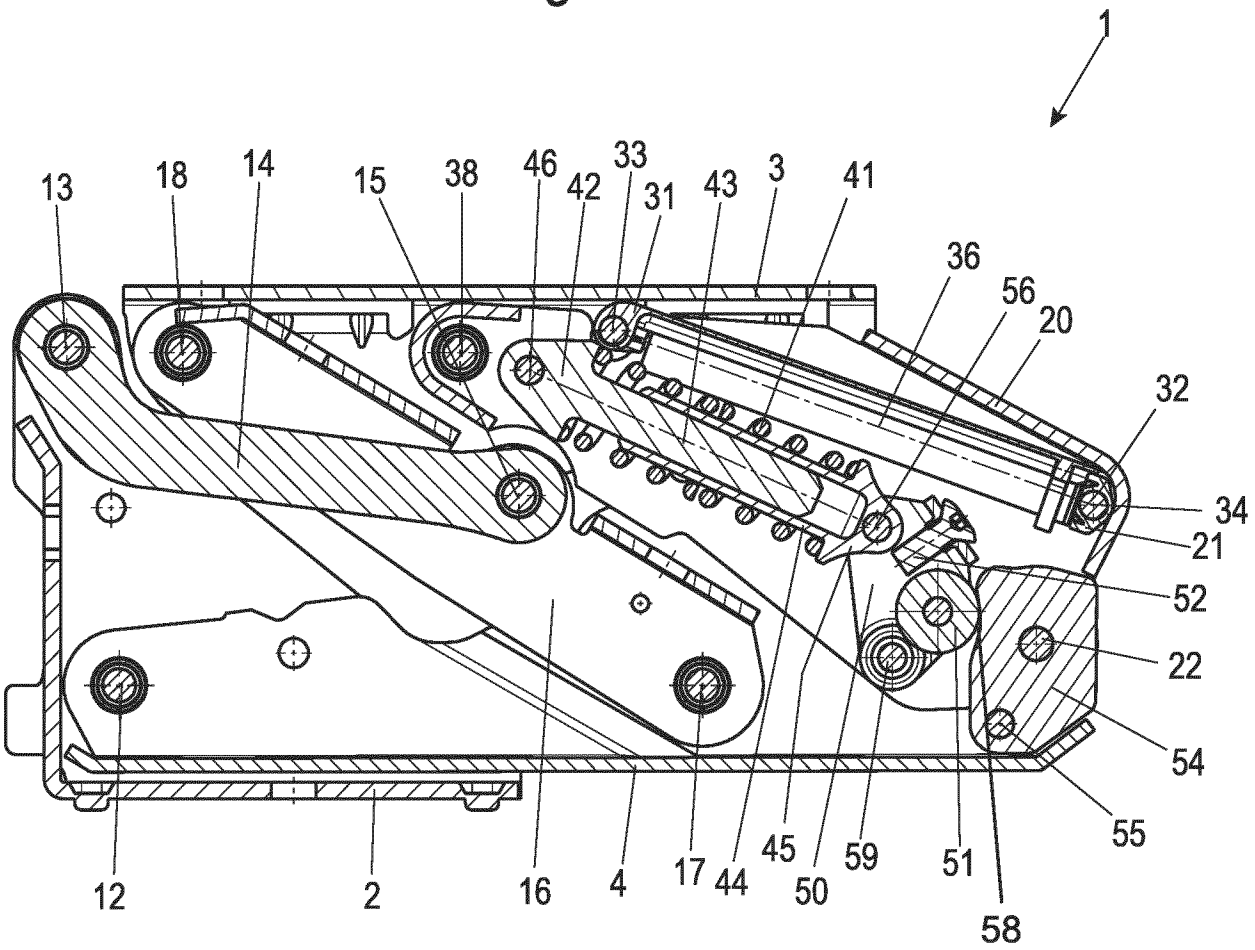
FIG. 4 shows a sectional view through the multi-joint hinge of FIG. 1.

The multi-joint hinge 1 illustrated in FIG. 1 is shown in a section in FIG. 4. The second lever 4 is rotatably mounted via an axis 12 on the base part 2, and a third lever 14 is rotatably mounted via an axis 13, which is provided spaced apart from the axis 12. The third lever 14 is articulated via an axis 15 in an opening 151 with a fourth lever 16, which is articulated via an axis 18 with the door bearing 3. The axis 18 extends through openings 181 on the fourth lever 16 and openings 182 on the door bearing 3 in this case. The fourth lever 16 is furthermore connected via an axis 17 to the second lever 4. The deflection lever 20 is rotatably connected via an axis 38 to the door bearing 3 and via an axis 22 to the second lever 4. The lever mechanism for connecting the base part 2 to the door bearing 3 thus comprises the second, third, and fourth levers 4, 14, 16 and the deflection lever 20 and seven axes 12, 13, 15, 17, 18, 22, and 38.

The multi-joint hinge 1 furthermore comprises a damping element 30 for braking a closing movement. The damping element 30 has one or more linear dampers, which are articulated with the deflection lever 20 and the door bearing 3. A spring element 40, which is also connected between the door bearing 3 and the deflection lever 20, is connected in parallel to the damping element 30. The spring element 40 comprises a spring 41 formed as a coiled spring, which is guided via a telescoping spring holder. The spring holder comprises an inner part 42, which is articulated via an axis 46 with the deflection lever 20, and an outer part 44, which encloses a spring axis 43 of the inner part 42 in the manner of a sleeve. The outer part 44 is articulated at the end via a bearing section 45 on an axis 56 with a spring lever 50. The spring lever 50 is rotatably mounted on the deflection lever 20 via an axis 59. The spring lever 50 furthermore forms a bearing for a roller 51, which rolls on a cam element 54. The cam element 54 is connected via two axes 22 and 55 to the lever 4, and it is determined via the cam element 54 in which area the spring 41 tensions and relaxes.

Figure 5:
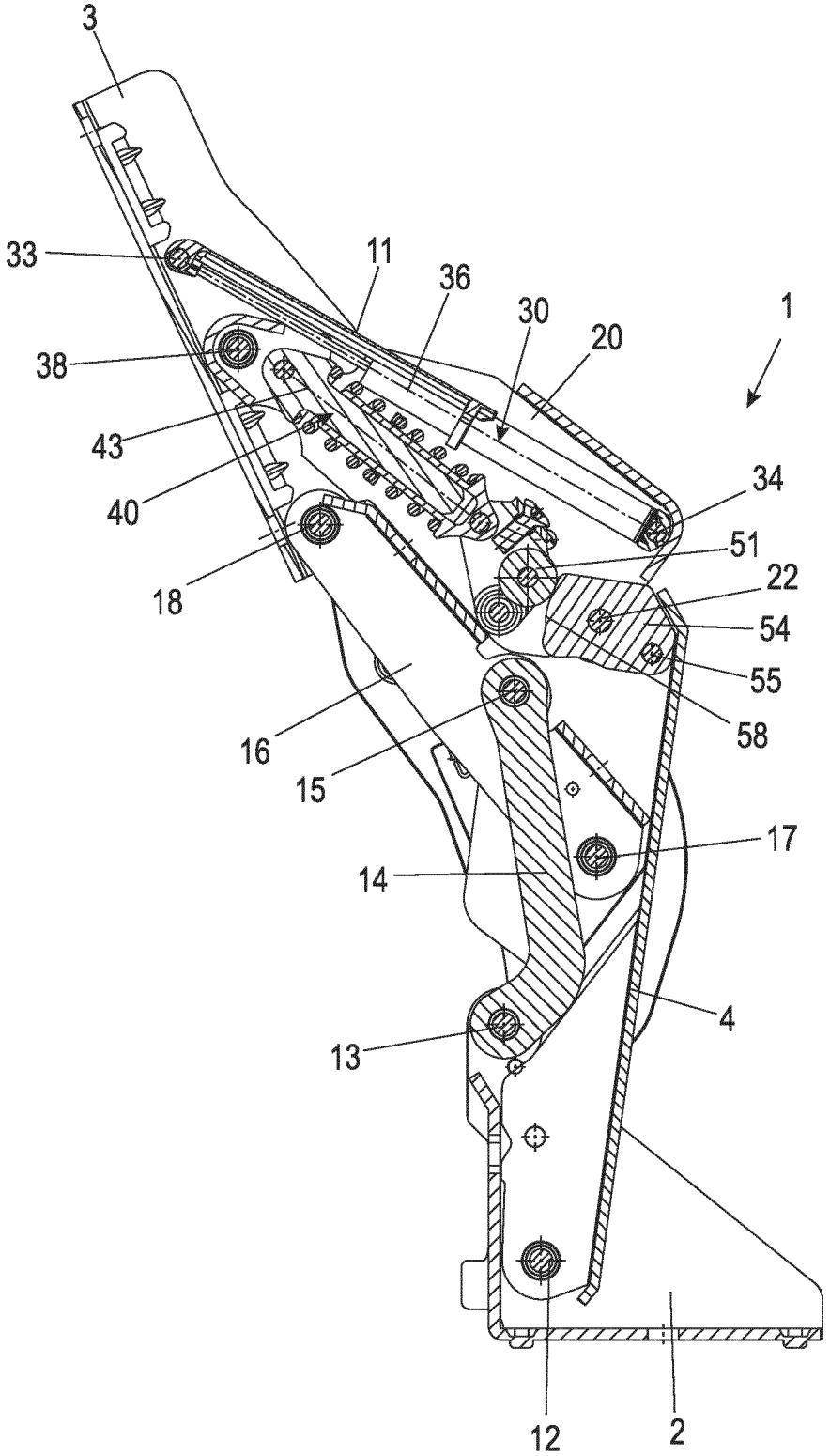
FIG. 5 shows a sectional view through the multi-joint hinge of FIG. 3.

The multi-joint hinge 1 is shown in a sectional view in the open position in FIG. 5. Although the door bearing 3 was pivoted by over 90°, the damping element 30 and the spring element 40 are located adjacent to one another and are aligned essentially parallel, similarly as shown in the closed position in FIG. 4. The damping element 30 comprises at least one damping axis 33, which extends parallel to a longitudinal axis of a linear damper, and the spring element 40 comprises a spring axis 43, which extends in the action direction of the spring 41. The damping axis 33 and the spring axis 43 are aligned approximately in parallel essentially over the entire opening area, in particular at an angle less than 20°, preferably less than 10°, particularly preferably less than 7°. The damping element 30 and the spring element 40 can thus be arranged closely adjacent to one another, which results in a particularly compact construction.

In FIGS. 4 and 5, a blocking means 52 is provided as a screw on the spring lever 50. This blocking means 52 is removed before the use of the multi-joint hinge 1. Instead of a screw, for example, a rivet as a mounting aid screw could also lock the maximally pre-tensioned spring, for example, in the open position or 50° position of the hinge, so that the hinge can be actuated without force and can be installed harmlessly.

Figure 6:
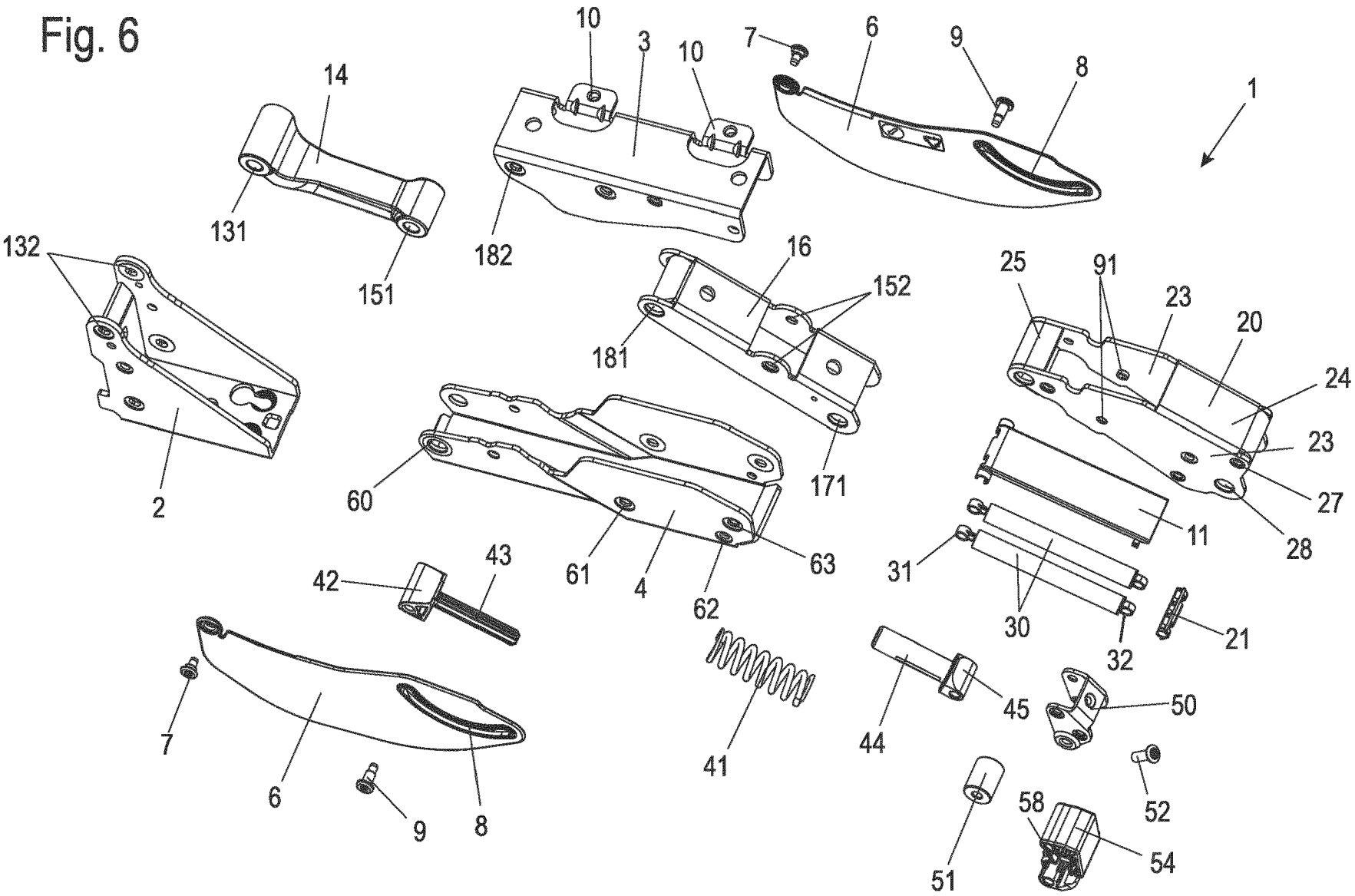
FIG. 6 shows a perspective exploded view through the multi-joint hinge of FIG. 1.
Figure 7:
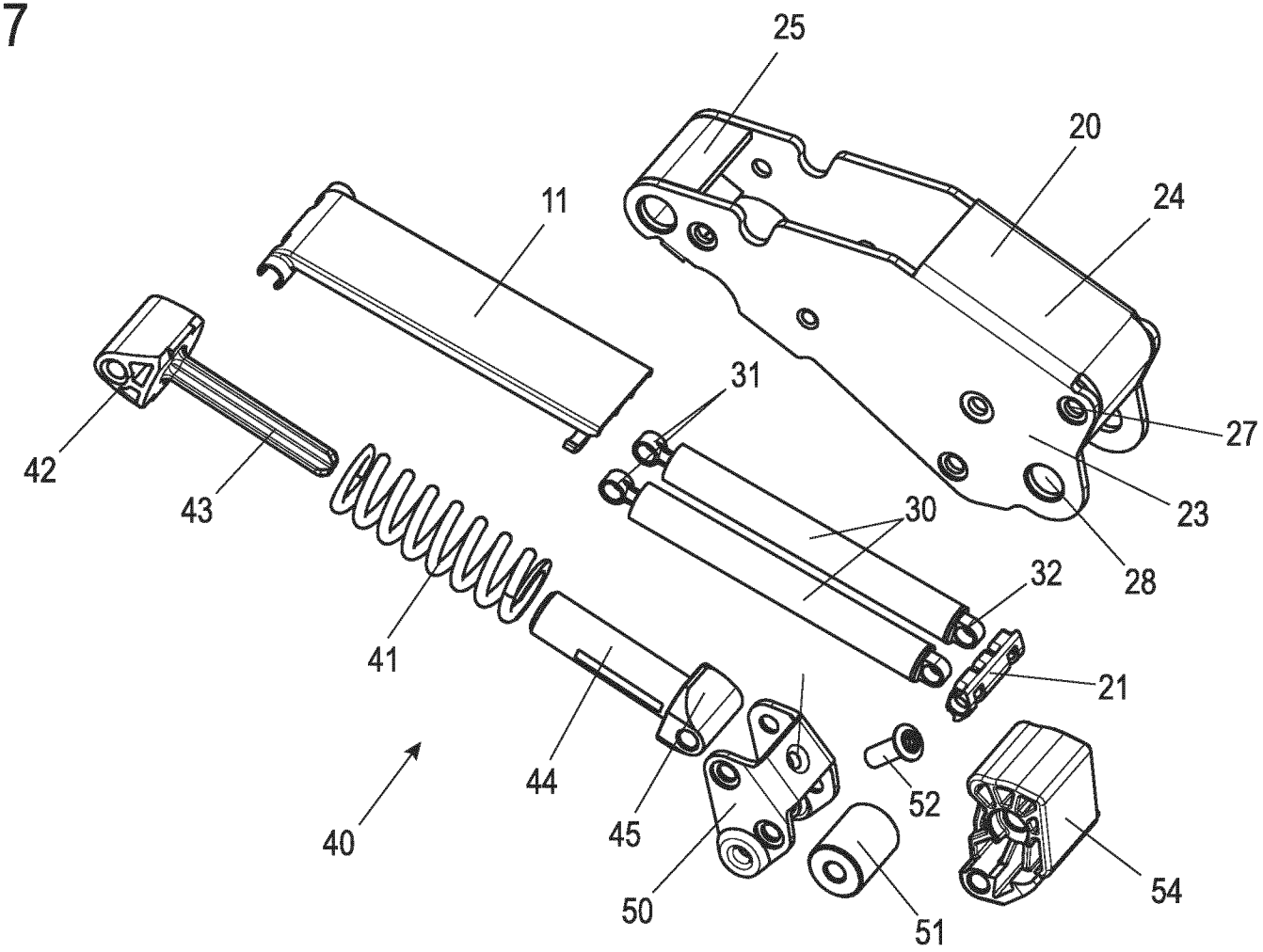
FIG. 7 shows a perspective exploded view of the area of the multi-joint hinge having the deflection lever, the damping element, and the spring element.
Figure 8:
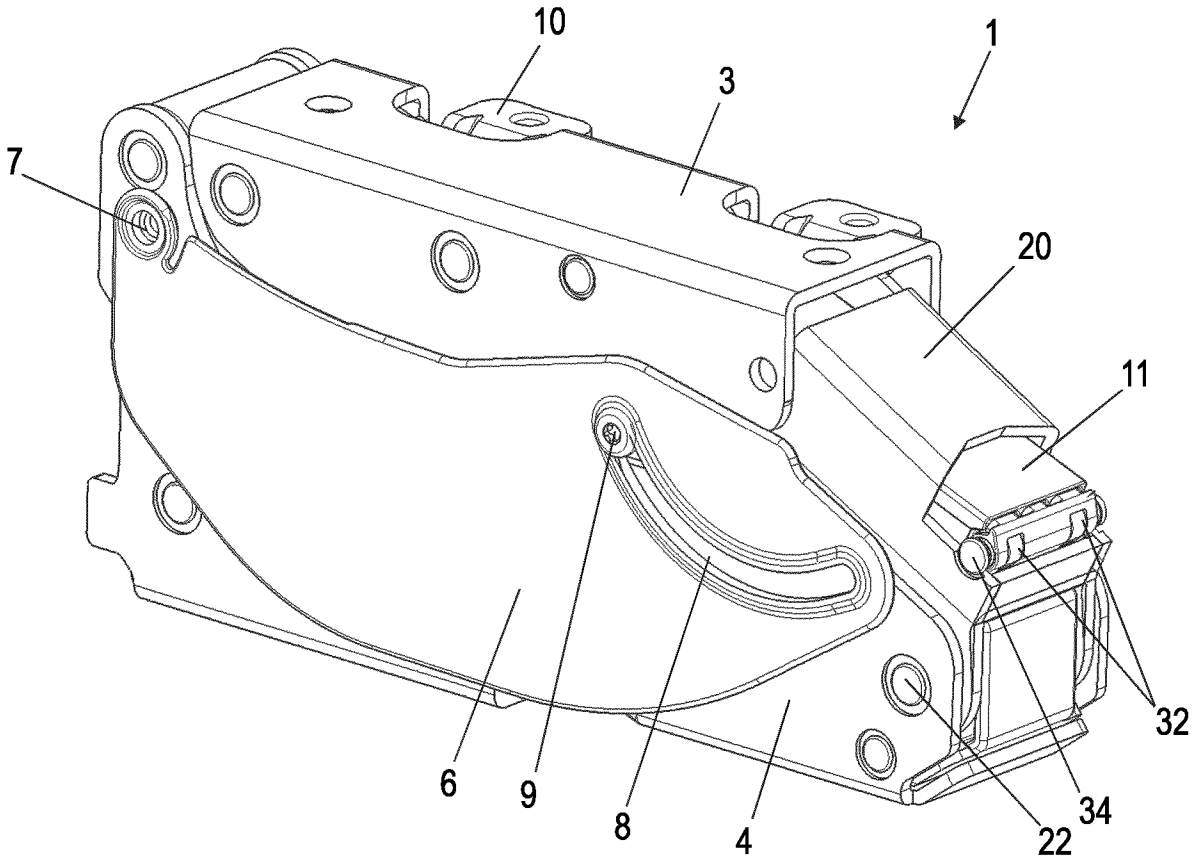
FIG. 8 shows a perspective view of the multi-joint hinge of FIG. 1, partially in section.
Figure 9:
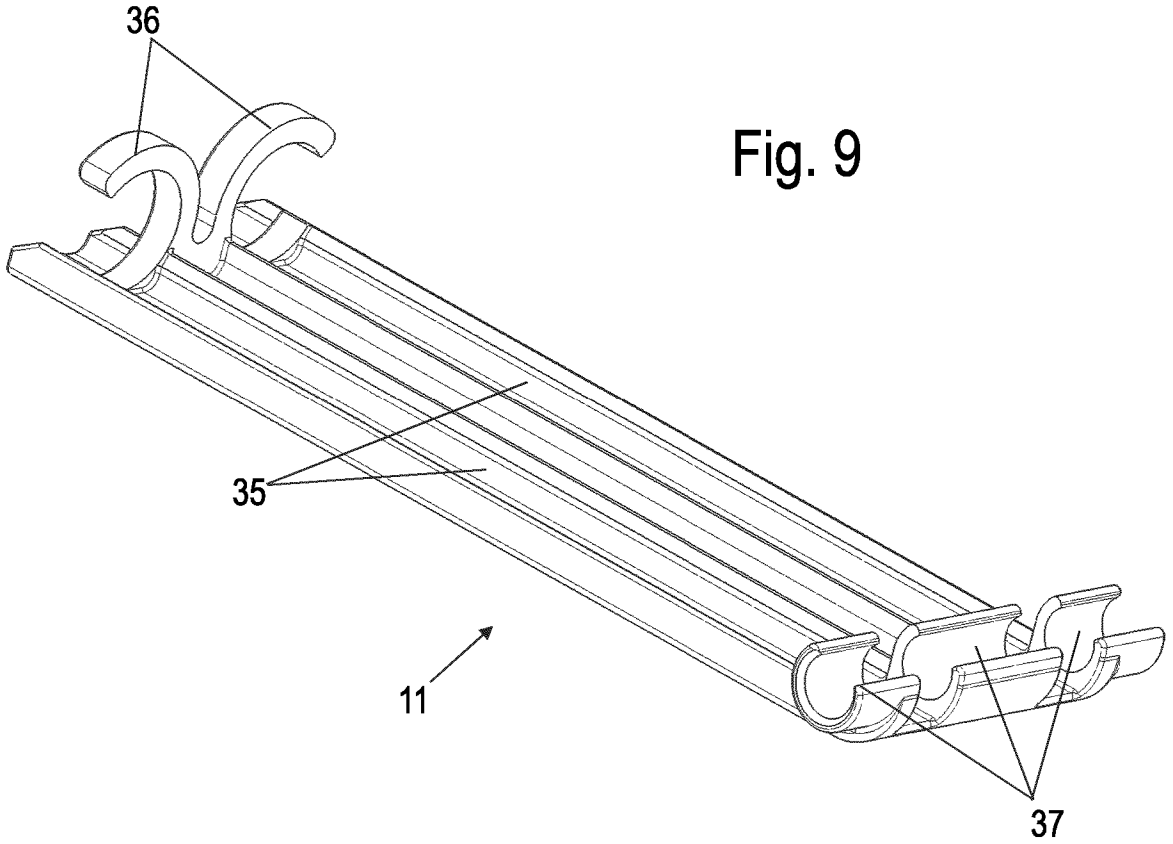
FIG. 9 shows a perspective view of the cap of the multi-joint hinge.

In FIG. 6, the multi-joint hinge 1 is shown with the individual parts in an exploded view, wherein the axes were omitted for more comprehensible illustration. The base part 2, the second lever 4, the fourth lever 16, and the deflection lever 20 and also the door bearing 3 are produced from U-shaped bent metal plates. The second lever 4 has openings 60, 61, 62, and 63 on opposing legs for the axes 12, 17, 22, and 55. Similarly, the fourth lever 16 has openings 152, 171, and 181 on opposing legs to fix the axes 15, 17, and 18 therein. An axis 13, which engages in openings 132 on the base part 2 and openings 131 on the third lever 14, is provided on one side on the third lever 14. At the opposing end, the axis 15 for linking the fourth lever 16 is provided. The cover 6 is rotatably mounted via the axis 7 on the base part 2, and the guide pin 9 in the curve guide 8 is fixed on an opening 91 on the deflection lever 20. The deflection lever 20 has two plate-shaped side parts 23, which are connected to one another via two spaced-apart connecting webs 24 and 25. An opening is formed on the deflection lever 20, which is covered by a cap 11, between the connecting webs 24 and 25. The cap 11 is fixed on an axis 33, on which the two linear dampers of the damping element 30 are also held at the end.

The deflection lever 20 is fixed on the axis 38 on the door bearing 3. The axis 33 extends through two eyes 31 of the linear damper in this case, wherein the linear dampers of the damping element 30 also have eyes 32 or catch elements on the opposing side, which are fixed on an axis 34 inside a holder 21. The holder 21 holds the eyes 32 of the dampers on the axis 34 at a defined distance in relation to one another. The axis 34 extends through two openings 27 on the deflection lever 20, which are provided adjacent to openings 28 for guiding through the axis 22.

When the multi-joint hinge 1 is moved from a closed position (FIGS. 1 and 4) in the opening direction, the door bearing 3 and the deflection lever 20 rotate in opposite directions around the axes 18 and 34. The area between the connecting web 24 and the connecting web 25 thus becomes accessible from the outside. To avoid an effect on the damping element 30 and the spring element 40 from the outside, the cap 11 covers the area of the opening between the connecting webs 24 and 25, wherein the cap 11 is moved in relation to the deflection lever 20 and hangs on the axis 33. This area is thus also arranged protected from an access from the outside in the open state.

The spring element 40 comprising the spring 41 between the inner part 42 and the outer part 44 is supported via the spring lever 50 and the roller 51, wherein the roller 51 rolls on the cam element 54 along a running surface 58. If the multi-joint hinge 1 is closed, the roller 51 moves over a projection on the cam element 54 and can ensure a relaxation of the spring 41 from a predetermined opening angle, for example, at approximately 30°, so that in the closing area between the closed position and the opening angle of approximately 30°, the spring element 40 is active and tensions the door bearing 3 in the closing direction.

The use of two parallel linear dampers enables the application of higher damping forces and the braking of even heavy door weights. The linear dampers are preferably filled with oil, such as silicone oil, for example, as fluid dampers. Other linear dampers comprising a cylinder and a piston movably mounted therein and a piston rod can also be used.

In the spring element 40, each spring 41 is designed as a compression spring. Of course, it is also possible to design the springs 41 as traction springs or to use more than only one spring 41 for the spring element 40.

Optionally, opening damping and/or closing damping can also be achieved via the linear dampers to brake the multi-joint hinge 1 via the damping element 30 upon reaching the maximally open position and/or closed position.

It is also possible to generate a stepped damping force behavior during a closing or opening procedure of the hinge, by the dampers providing a differing damping action at different opening or closing angles.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 multi-joint hinge
2 base part
3 door bearing
4 lever
6 cover
7 axis
8 curve guide
9 guide pin
91 opening
10 tab
11 cap
12 axis
13 axis
131 opening
132 opening
14 lever
15 axis
151 opening
152 opening
16 lever
17 axis
171 opening
18 axis
181 opening
182 opening
20 deflection lever
21 holder
22 axis
23 side part
24 connecting web
25 connecting web
27 opening
28 opening
30 damping element
31 eye
32 eye
33 axis
34 axis
35 guide channel
36 catch element
38 axis
40 spring element
41 spring
42 inner part
43 spring axis
44 outer part
45 bearing section
46 axis
50 spring lever
51 roller
52 blocking means
54 cam element
55 axis
56 axis
58 running surface
59 axis
60 opening
61 opening
62 opening
63 opening

The invention claimed is:

1. A multi-joint hinge comprising:

a base part, on which a door bearing is pivotably held via a lever mechanism comprising multiple levers mounted in a parallelogram, wherein the multiple levers include a deflection lever, a second lever, a third lever, and a fourth lever, wherein the deflection lever is rotatably connected to the door bearing and the second lever, the second lever is rotatably mounted on the base part, the third lever is rotatably mounted on the base part and the fourth lever, and the fourth lever is rotatably mounted on the door bearing and the second lever;

a spring lever rotatably mounted on the deflection lever, the deflection lever has a receptacle between two plates, the two plates are connected to one another via at least one connecting web;

a damping element comprising: at least two linear dampers and a damping axis;

a cap having two guide channels and catch elements configured to guide or fix the at least two linear dampers, and is configured to cover an interior of the deflection lever; and at least one linearly acting spring comprising a spring axis and configured to pull the door bearing in a closing direction starting from a predetermined angle from a closed position of the multi-joint hinge, the damping element and the at least one linearly acting spring are independently fixed to different portions of the deflection lever and of the door bearing, the damping element is directly connected to the deflection lever and the cap is directly connected to the door bearing, the at least one linearly acting spring is connected to the deflection lever via the spring lever and is directly connected to the door bearing, and wherein, due to connections of the multiple levers, the spring lever, the damping element, and the at least one linearly acting spring, the damping axis and spring axis are arranged with respect to one another at an angle of less than 10 degrees from parallel over an entire range of motion of the door bearing.

2. The multi-joint hinge of claim 1, wherein the multi-joint hinge, in a closed position, is box-shaped, which is defined by the base part, the door bearing, and the multiple levers.

3. The multi-joint hinge of claim 1, wherein the multi-joint hinge has seven axes.

4. The multi-joint hinge of claim 1, wherein the lever mechanism is concealed by two plate-shaped covers, which are arranged on opposing sides of the multi-joint hinge, are pivotably mounted, and have a curve guide.

5. The multi-joint hinge of claim 1, wherein the damping element and the at least one linearly acting spring are arranged on the receptacle.

6. The multi-joint hinge of claim 1, wherein the cap covers an opening of the deflection lever.

7. The multi-joint hinge of claim 1, wherein the cap is rotatably mounted on the door bearing at the damping axis.

* * * * *